US005709160A

United States Patent [19]

Werge-Olsen et al.

[11] Patent Number: 5,709,160

[45] Date of Patent: Jan. 20, 1998

[54] APPARATUS FOR THE COMBUSTION OF FLUIDS WITH HIGH PARTICLE CONTENT

[75] Inventors: Arne Werge-Olsen; Anders Ruud, both of Årdalstangen; Inge Holden, Kvanne, all of Norway

[73] Assignee: Norsk Hydro a.s., Oslo, Norway

[21] Appl. No.: 550,293

[22] Filed: Oct. 30, 1995

[30] Foreign Application Priority Data

Oct. 28, 1994 [NO] Norway ..... 944107

[51] Int. Cl.[6] ..... F23C 1/10

[52] U.S. Cl. ..... 110/262; 110/238; 110/104 B; 110/218; 366/264

[58] Field of Search ..... 110/347, 218, 110/219, 104 B, 260–262, 238; 431/4; 366/263, 264

[56] References Cited

U.S. PATENT DOCUMENTS 2,890,659 6/1959 Haentjens et al. ..... 366/264 X 3,357,375 12/1967 Brophy ..... 110/219 X 4,534,654 8/1985 Alt et al. ..... 366/264 X 4,599,954 7/1986 Williams ..... 110/238 X

*Primary Examiner*—Henry A. Bennett

*Assistant Examiner*—Susanne C. Tinker

*Attorney, Agent, or Firm*—Wenderoth, Lind & Ponack

[57] ABSTRACT

An apparatus for the combustion of a suspension of a combustible liquid and combustible solids in particle shape, for instance carbon particles, includes a tank, a burner unit and a pipe which is connected to the burner unit and which protrudes into the tank where it is connected to a pump system. The pump system includes an eddy current pump with a branched outlet, where one of the outlet branches is connected to the pipe, while the other branch or branches is formed as a nozzle or a jet with its outlet directed into the tank, thus serving to stir the suspension in the tank.

10 Claims, 2 Drawing Sheets

APPARATUS FOR THE COMBUSTION OF FLUIDS WITH HIGH PARTICLE CONTENT

BACKGROUND OF THE INVENTION

The present invention relates to equipment or apparatus for the combustion of a suspension of a combustible liquid that contains a large amount of combustible material as solids in particle shape, for instance carbon particles. The equipment comprises a tank, a burner unit and a pipe for fluid transport, such pipe being arranged between the burner and an injection- or a feed pump located inside the tank.

Norwegian patent No. 171127, describes an equipment of the type as mentioned above, comprising a pump of the displacement type, i.e. a ordinary gear pump. When using this type of pump, it is experienced that it will operates a satisfactory manner when combusting viscous liquids such as tar from filters with small amounts of particles. However, when pumping suspensions with a larger content of carbon particles, pumps of this type are rapidly worn out, and have to be replaced. Another problem related to this known technique is that particles contained in the liquid precipitate and settle at the bottom of the tank, and thus may cause clogging at the pump inlet.

SUMMARY OF THE INVENTION

It is an object of the present invention to provide a technical solution where the above mentioned problems are eliminated or substantially avoided. Thus, the invention represents a solution where the problems related to particle precipitation are avoided, and further the problem of excessive pump wear is substantially reduced.

In accordance with the invention the equipment or apparatus is characterized in that the pump employed is an eddy current pump with a branched outlet, where one of the branches is connected with the pipe for transport of fluid to the burner, while the other branch or branches ends up in the tank and serves to stir the suspension contained in the tank.

In carbon plants around the world, for instance plants that produce carbon bodies for the aluminum industry, there is a large excess of carbon dust. This is generally carbon dust with a particle size less than 100 μm. Carbon dust of this type is today deposited, and represents in this manner a loss for the companies that "produce" the dust.

When using the combustion equipment according to the present invention, the carbon dust may be combusted when mixing it with for instance waste oil. Tests have shown that it is possible to mix up to 50% (weight) coke dust in the oil, and having a quantity of energy corresponding to 36000 kJ/kg (10 kWh/kg), the use of carbon dust for combustion purposes represents a substantial saving in energy costs per year. Besides, the use of carbon dust for combustion purposes will, in addition, lead to a reduction in the amount of dust to be deposited and correspondingly a reduced demand for waste depositing areas, thus having good environmental effects.

BRIEF DESCRIPTION OF THE DRAWINGS

The invention will now be further described by means of examples and with reference to the drawings where.

DETAILED DESCRIPTION OF THE INVENTION

Figure 1:
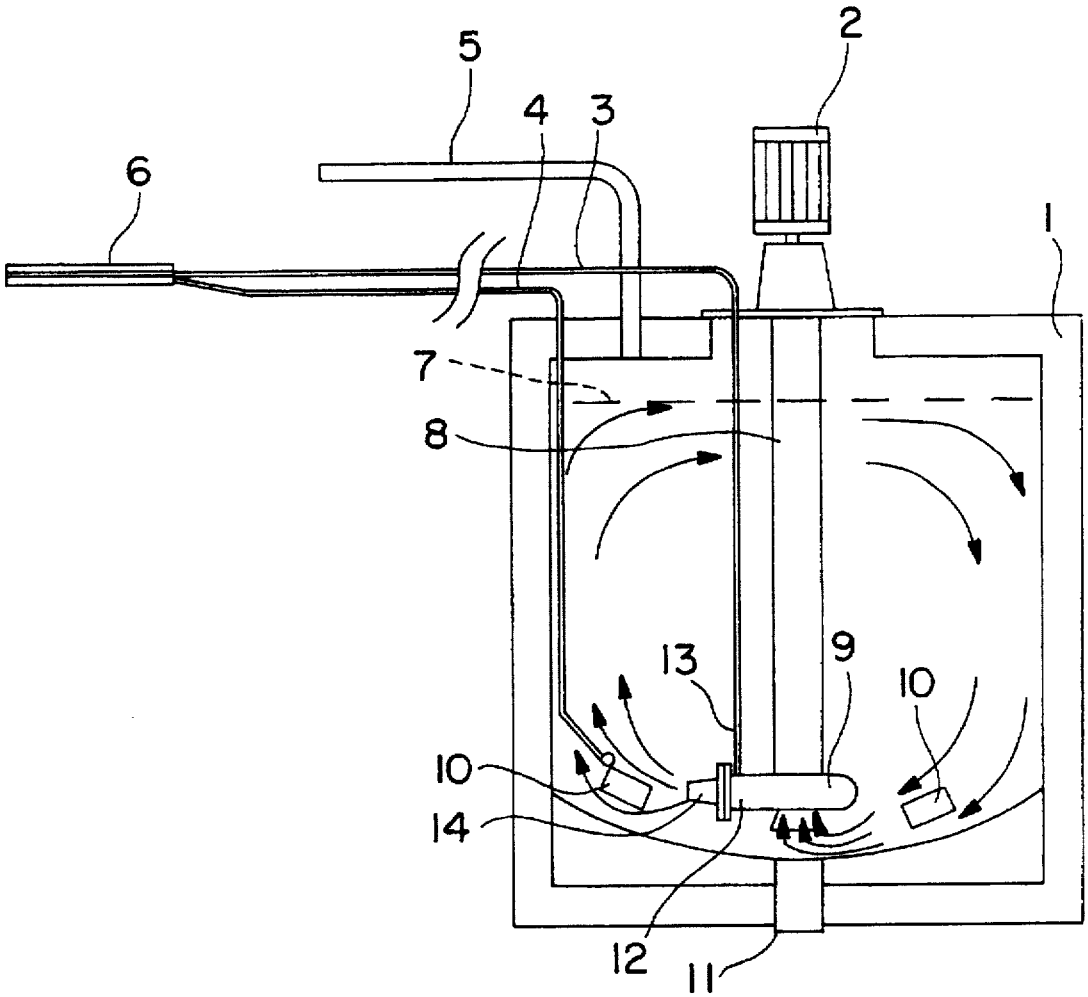
FIG. 1 shows a principal sketch of the equipment according to the invention.

FIG. 1 shows an insulated tank 1 that is adapted to contain a suspension of a combustible liquid mixed with carbon particles. At the interior of the tank there is arranged an eddy current pump 9 driven by a shaft 8 that is connected to a motor 2 placed at the top of the tank. The pump 9, that is further shown in FIG. 2, has a branched outlet where one of the branches 13 is connected with a burner 6 via a pipe 3, while another branch, or possibly two or more branches 14, is formed as a jet or a nozzle that is open towards its surroundings inside the tank. In this manner the pump is partly arranged to supply the burner 6 with suspension from the tank and partly arranged to circulate the suspension in the tank via the nozzle or the nozzles 14 to maintain the suspension of liquid and particles in the tank. The liquid level in the tank is monitored by a level monitor 7, that is not further shown in the FIG. 1. Moreover, the tank is provided with one or more heating elements 10 to, if necessary, warm up the contents of the tank, in case the tank contains a viscous, temperature dependent liquid. In addition, a suction pipe 5 is arranged in connection with the tank for evacuating possible vaporized components out of the tank.

Figure 2:
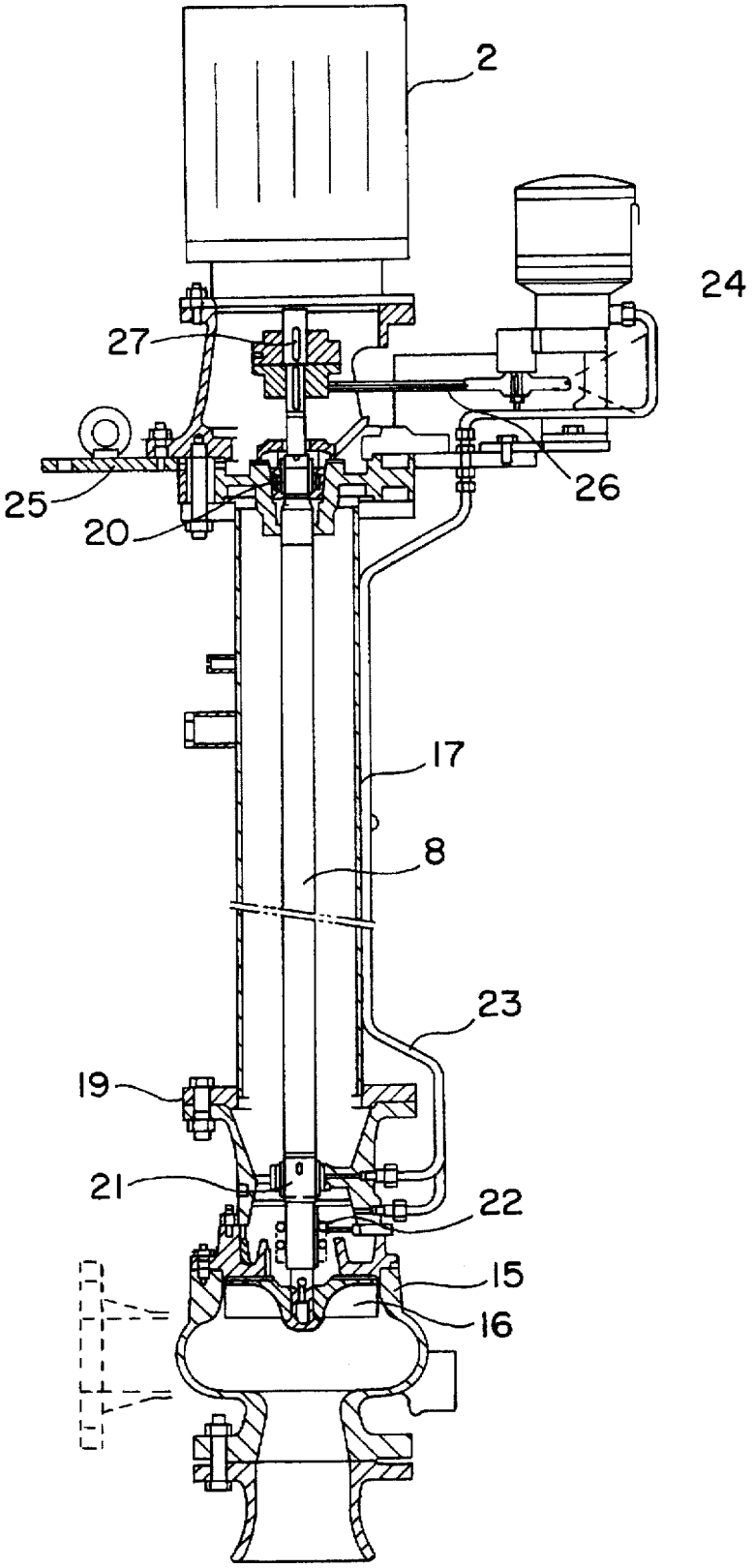
FIG. 2 shows on an enlarged scale an eddy current pump as shown in FIG. 1.

The eddy current pump 9 with fastening means and motor 2 is shown on an enlarged scale in FIG. 2. The pump comprises a pump housing 15 with an internal driven eddy current impeller or rotor 16, driven by shaft 8. The rotor used in the pump may preferably be of the brand EGGER. As will be apparent from a consideration of FIGS. 1 and 2 of the drawings, the pump inlet of housing 15 is directed downwardly and is located below the impeller 16. As also will be apparent from FIGS. 1 and 2, the outlet branches 13, 14 are directed generally radially outwardly from housing 15.

The pump housing and thereby the pump is connected to an axle or shaft housing 17 by a flange connection 19. The purpose of the axle housing, besides serving a connection for the pump, is to provide a sealing of the shaft 8 and its bearings 20, 21, and in addition the pump bearing 22, against the surrounding liquid (suspension) in the tank. The bearings 21,22 are pressure lubricated by means of pressurized oil pipes 23 supplying oil from an oil reservoir or a pump 24 driven by a transmission belt 26 connected to the shaft 8.

The axle housing 17 is at its top end attached to a removable hatch or cover 25 providing easy removal of the pump including its axle housing and driving motor, when performing maintenance or replacement operations.

In the illustrated embodiment, the axle or shaft 8 is driven by the motor 2 via direct connecting means 27. It should be understood that other connecting means, such as transmission belts or gears, may alternatively be used within the scope of the invention.

We claim:

1. An apparatus for combusting a suspension of combustible liquid and combustible solids in particle shape, said apparatus comprising:

a tank having an interior to contain suspension to be combusted;

a burner unit positioned outwardly of said tank for combusting the suspension;

an eddy current pump positioned in said tank, said pump including a housing, an impeller in said housing, a pump inlet into said housing located at a position below said impeller and a branched pump outlet from said housing including at least first and second outlet branches;

a pipe connected to said first outlet branch and to said burner unit to convey suspension to said burner unit; and said second outlet branch comprising a nozzle for directing a jet of the suspension into the suspension in said tank to thereby stir the suspension.

2. An apparatus as claimed in claim 1, wherein said nozzle of said second outlet branch is directed generally radially outwardly from said housing.

3. An apparatus as claimed in claim 2, further comprising at least one heating element within said interior of said tank for heating the suspension.

4. An apparatus as claimed in claim 3, wherein said heating element is located at a position within the path of a jet of suspension discharged by said nozzle.

5. An apparatus as claimed in claim 1, further comprising at least one heating element within said interior of said tank for heating the suspension.

6. An apparatus as claimed in claim 5, wherein said heating element is located at a position within the path of a jet of suspension discharged by said nozzle.

7. An apparatus as claimed in claim 1, wherein said pump further includes bearings, and further comprising an oil pump connected to said bearings for achieving pressure lubrication thereof.

8. An apparatus as claimed in claim 1, wherein said pump inlet opens downwardly from said housing into said interior of said tank.

9. An apparatus as claimed in claim 1, further comprising a removable hatch at the top of said tank, a shaft housing connected to said hatch and to said housing of said pump, and a drive shaft driven extending through said shaft housing and connected to said impeller.

10. An apparatus as claimed in claim 9, further comprising a pump motor mounted on said hatch and connected to said drive shaft for driving said drive shaft and said impeller.

* * * * *